United States Patent [19]

Alberty et al.

[11] Patent Number: 4,734,667

[45] Date of Patent: Mar. 29, 1988

[54] ARRANGEMENT FOR COUPLING WAVEGUIDE MODES BETWEEN TWO WAVEGUIDES VIA A SEMICONDUCTOR ELEMENT

[75] Inventors: Michael Alberty, Backnang; Walter Gross, Auenwald, both of Fed. Rep. of Germany

[73] Assignee: ANT Nachrichtentechnik GmbH, Backnang, Fed. Rep. of Germany

[21] Appl. No.: 10,789

[22] Filed: Feb. 4, 1987

[30] Foreign Application Priority Data

Feb. 5, 1986 [DE] Fed. Rep. of Germany ..... 3603454

[51] Int. Cl.[4] ..... H01P 5/00

[52] U.S. Cl. ..... 333/250; 330/286; 333/254; 455/328

[58] Field of Search ..... 333/113, 208, 212, 248, 333/250, 254, 209, 211, 218; 330/56, 286, 287; 331/107 DP; 455/325, 328

[56] References Cited

U.S. PATENT DOCUMENTS

| | | | |
|---|---|---|---|
| 3,017,585 | 1/1962 | Luke | 333/113 X |
| 3,092,711 | 6/1963 | Cohn | 333/254 X |
| 3,379,956 | 4/1968 | Battles et al. | 333/218 |

OTHER PUBLICATIONS

I. Angelov, A Spasov, I. Stoev, L. Urshev, "Investigation of Some Guiding Structures for Low-Noise FET Amplifiers", European Microwave Conference 1985, pp. 535-540.

*Primary Examiner*—Paul Gensler

*Attorney, Agent, or Firm*—Spencer & Frank

[57] ABSTRACT

An arrangement for coupling waveguide modes between two waveguides via a semiconductor element. The two waveguides each have a short-circuiting end wall and a common side wall constituting a common partition wall between the waveguides so that the two waveguides extend parallel to, and overlap one another at least over a partial length where they are separated from one another by the common side wall. The common partition wall is provided with a coupling aperture and the semiconductor element is inserted into the coupling aperture between the two waveguides and is in ground contact with the common partition wall. The semiconductor element has two connectng arms, one connecting arm extending as a coupling probe into one of the waveguides and the other connecting arm extending as a coupling probe into the other waveguide.

8 Claims, 4 Drawing Figures

ARRANGEMENT FOR COUPLING WAVEGUIDE MODES BETWEEN TWO WAVEGUIDES VIA A SEMICONDUCTOR ELEMENT

BACKGROUND OF THE INVENTION

The present invention relates to an arrangement for coupling waveguide modes between two waveguides via a semiconductor element, with the semiconductor element being inserted into a coupling aperture in a partition between the two waveguides and being in ground contact with this partition. In such an arrangement the semiconductor element has two connecting arms, one of which extends as a coupling probe into one waveguide and the other of which extends as a coupling probe into the other waveguide.

Such an arrangement is disclosed in a publication by I. Angelov, A. Spasov, I. Stoev, L. Urshev, entitled "Investigation of Some Guiding Structures for Low-Noise FET Amplifiers", European Microwave Conference 1985, pages 535–540. This publication describes a high frequency amplifier whose amplifier element is a field effect transistor (FET). The FET is coupled in the manner described above to an input waveguide and to an output waveguide, both being disposed one behind the other along a common axis. This known arrangement has a drawback in that its structural length is unusually large, particularly if a multistage amplifier is involved.

SUMMARY OF THE INVENTION

It is an object of the present invention to provide an arrangement of the above-mentioned type which has very little attenuation and has the shortest possible structural length.

The above and other objects are accomplished in the context of an arrangement for coupling waveguide modes between two waveguides via a semiconductor element as first described above, wherein, according to the invention, the waveguides each have a short-circuiting end wall and a common side wall constituting the common partition wall between the waveguides so that the two waveguides extend parallel to, and overlap one another at least over a partial length where they are separated from one another by the common side wall.

Advantageously, in the arrangement according to the invention, the connecting arms serving as coupling probes of the semiconductor element may be very short. It is possible, therefore, to permit very thin connecting arms to extend freely into the waveguides without having to support them by special means.

The overlap of input and output waveguides in the coupling range according to the invention has the advantage that it results in a considerable reduction of the structural length of the device, particularly in multistage high frequency amplifiers, compared to comparable prior art arrangements.

The invention will be described in greater detail below with reference to an embodiment that is illustrated in the drawings.

DESCRIPTION OF THE PREFERRED EMBODIMENTS

Figure 1:
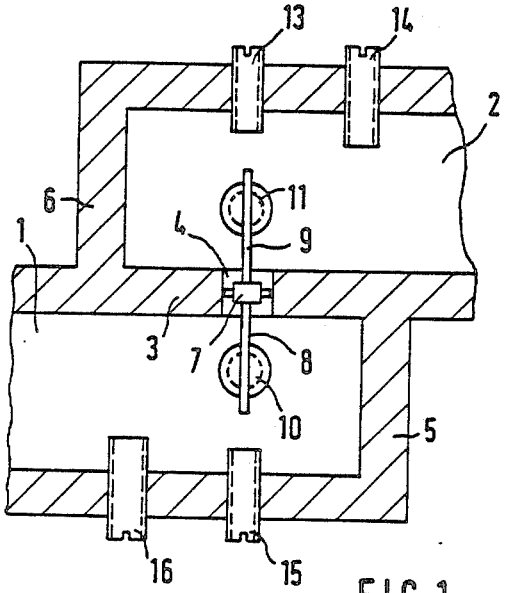
FIG. 1 is a partial longitudinal sectional view of two waveguides and a semiconductor element disposed therein according to one embodiment of the invention.

FIG. 1 is a longitudinal sectional view of a microwave circuit, e.g. an amplifier, oscillator, mixer or the like, which includes an input waveguide and an output waveguide. Input waveguide 1, which is short circuited at its end wall 5, and output waveguide 2, likewise short-circuited at its end wall 6, are parallel to one another over a length of about $\lambda/8$ to $\lambda/2$ ($\lambda \hat{=}$ waveguide wavelength) and are separated from one another in a region of overlap by a common side wall 3 on the broadside of the waveguides and common to both waveguides in the overlap region. Input waveguide 1 is coupled with output waveguide 2 by means of a coupling aperture 4 provided in common side wall 3. This coupling aperture is spaced at about $\lambda/16$ to $\lambda/4$ from the inner surface of short-circuiting end wall 5 of input waveguide 1 and by the same distance from the inner surface of short-circuiting end wall 6 of output waveguide 2.

An active semiconductor element 7 (e.g. a diode or an FET) of the microwave circuit is inserted into coupling aperture 4 between the two waveguides 1 and 2 and is in ground contact with common side wall 3. A first connecting arm 8 of semiconductor element 7 projects into input waveguide 1 and there couples into semiconductor element 7 the mode of the input signal. A second connecting arm 9 of semiconductor element 7 projects into output waveguide 2 and couples into it the modes of the signal which have been, for example, amplified or multiplied in frequency by the semiconductor element. Connecting arms 8 and 9, which serve as coupling probes for semiconductor element 7, have a length that is about 0.3 to 0.8 times the length of the narrow side of the waveguide (i.e. about 0.15 to 0.35 cm at an operating frequency of 20 GHz). Because this requires only very short coupling probes, very thin and not very stable connecting arms can project freely into waveguides 1 and 2, respectively, and need no separate support.

Connecting arms 8 and 9 of semiconductor element 7 are supplied with a direct voltage through coaxial feedthrough 10 and 11 in the walls of waveguides 1 and 2, respectively. As shown by the view into input waveguide 1 in FIG. 2, the direct voltage is fed to connecting arm 8 of semiconductor element 7 through a thin wire 12 which passes through the waveguide perpendicularly to the E field. This type of direct voltage supply assures that the waveguide field is interfered with as little as possible and that the attenuation during coupling is relatively low.

Matching the coupling between the waveguides and the semiconductor element can be effected in a simple manner by means of tuning screws 13, 14 and 15, 16, respectively, which project into waveguides 1 and 2 through the waveguide walls opposite coupling aperture 4 in the vicinity of coupling probes 8 and 9.

Figure 2:
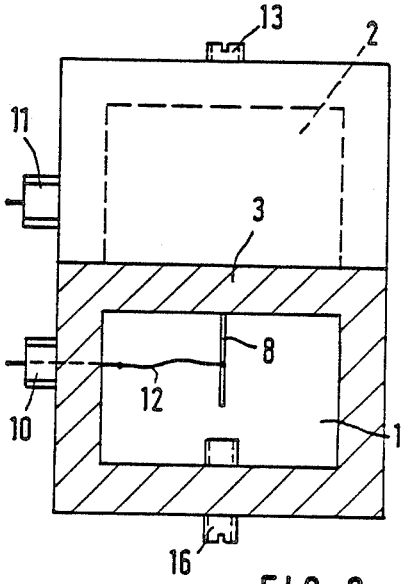
FIG. 2 is an end view into a waveguide arranged as shown in FIG. 1.
Figure 3:
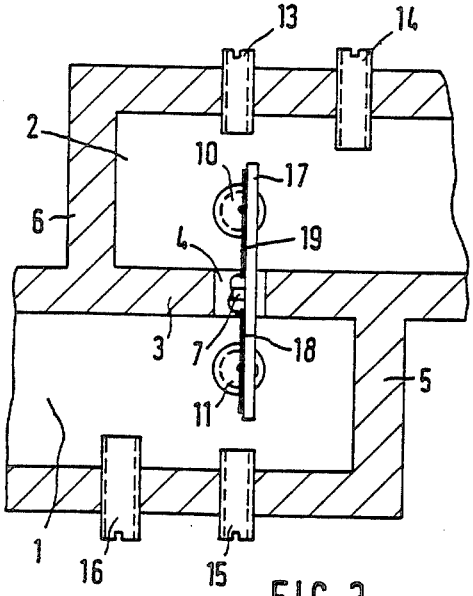
FIG. 3 shows a similar arrangement as FIG. 1, but with the semiconductor element applied to a dielectric substrate wafer.
Figure 4:
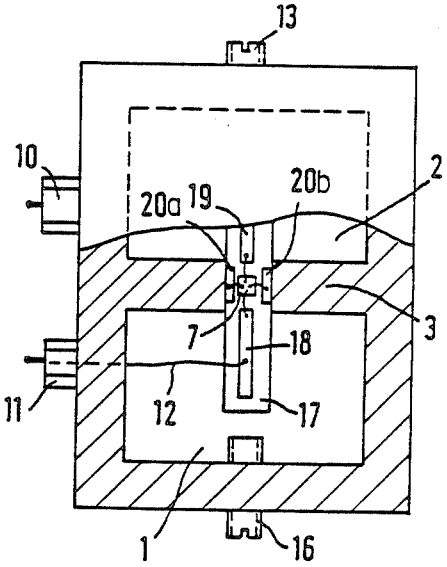
FIG. 4 is an end view into a waveguide arranged as shown in FIG. 3.

The arrangement shown in FIGS. 3 and 4 is identical with the above-described arrangement of FIGS. 1 and 2 except for the mounting of the semiconductor element and the configuration of the coupling probes. Therefore, the same reference numerals can be found in FIGS. 3 and 4 as are used in FIGS. 1 and 2. In the embodiment shown in FIGS. 3 and 4, a semiconductor element 7, which is not accommodated in a package, is placed onto a dielectric substrate 17. At one side, substrate 17 is provided with two conductor paths 18 and 19 which each have a length of about 0.3 to 0.8 times the length of the narrow side of the waveguide and extend in opposite directions. Two contact terminals of semiconductor element 7 are connected with these conductor paths by means of bonding wires. Substrate 17 is provided with two further conductive areas 20*a* and 20*b* with which the semiconductor element is grounded. This dielectric substrate 17, equipped with semiconductor element 7, is installed in coupling aperture 4 so that its conductive areas 20*a* and 20*b* are contacted with common side wall 3 and its conductor paths 18 and 19 project into waveguides 1 and 2 as coupling probes.

The present disclosure relates to the subject matter disclosed in German P No. 36 03 454.1 of Feb. 5, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an arrangement for coupling waveguide modes between two waveguides via a semiconductor element, wherein the two waveguides have a common partition wall provided with a coupling aperture, the semiconductor element is inserted into the coupling aperture between the two waveguides, is in ground contact with the common partition wall, and has two connecting arms, one connecting arm extending as a coupling probe into one of the waveguides and the other connecting arm extending as a coupling probe into the other waveguide, the improvement wherein:

said waveguides each have a short-circuiting end wall and a common side wall constituting said common partition wall so that said two waveguides extend parallel to, and overlap one another at least over a partial length where they are separated from one another by said common side wall.

2. Arrangement as defined in claim 1, wherein said coupling aperture is inserted into said common side wall of the two waveguides at a distance of $\lambda/16$ to $\lambda/4$ from a respective one of said short-circuiting end walls, wherein $\lambda$ is the waveguide wavelength.

3. Arrangement as defined in claim 1, and further including a dielectric substrate mounting said semiconductor element, said semiconductor element having contact terminals; two conductor paths extending in opposite directions on said dielectric substrate and being connected with the contact terminals of said semiconductor element; and at least one conductive area disposed on said dielectric substrate with which said semiconductor element is in ground contact; wherein said dielectric substrate is disposed in said coupling aperture with said at least one conductor area connected with said common side wall and said conductor paths each projecting as a said coupling probe into a respective one of said two waveguides.

4. Arrangement as defined in claim 3, wherein said waveguides each have a broad side and a narrow side and said conductor paths each have a length which is 0.3 to 0.8 times the length of the narrow side of the respective waveguide into which it extends.

5. Arrangement as defined in claim 3, including wires for supplying a direct voltage each being connected with a respective one of said conductor paths, said wires each extending perpendicularly to an E field of a respective one of said waveguides.

6. Arrangement as defined in claim 1, including tuning pins projecting into said waveguides through side walls of said two waveguides and being disposed opposite said common side wall in the vicinity of said coupling probes.

7. Arrangement as defined in claim 1, wherein said waveguides each have a broad side and a narrow side and said connecting arms each have a length of 0.3 to 0.8 times the length of the narrow side of the respective waveguide into which it extends.

8. Arrangement as defined in claim 1, including wires for supplying a direct voltage each being connected with a respective one of said connecting arms, said wires each extending perpendicularly to an E field of a respective one of said waveguides.

* * * * *